United States Patent [19]

Mabery

[11] 4,175,419

[45] Nov. 27, 1979

[54] NO-SIZE SQUEEZING OF 180 DEGREE BOILER-TUBE RETURN BENDS

[75] Inventor: Thomas L. Mabery, Chattanooga, Tenn.

[73] Assignee: Combustion Engineering, Inc., Windsor, Conn.

[21] Appl. No.: 891,958

[22] Filed: Mar. 31, 1978

[51] Int. Cl.[2] ..... B21D 7/03

[52] U.S. Cl. ..... 72/383; 72/369; 72/386; 72/400; 29/157 A

[58] Field of Search ..... 29/157 A; 72/353, 357, 72/360, 367, 369, 383, 386, 399, 398, 400

[56] References Cited

U.S. PATENT DOCUMENTS

| | | | |
|---|---|---|---|
| 1,923,272 | 8/1933 | Maroto | 72/369 X |
| 2,466,877 | 4/1949 | Cross | 72/369 X |
| 2,689,596 | 9/1954 | Huet | 72/369 X |
| 2,830,645 | 4/1958 | Huet | 72/367 |
| 2,983,995 | 5/1961 | Gresse | 72/369 |
| 3,453,857 | 7/1969 | Reckard | 72/357 |
| 3,606,788 | 9/1971 | Whitman | 72/399 X |
| 3,869,917 | 3/1975 | Lapp | 72/369 X |

FOREIGN PATENT DOCUMENTS

| | | | |
|---|---|---|---|
| 154073 | 11/1953 | Australia | 72/367 |
| 449224 | 6/1948 | Canada | 72/400 |
| H 7745 | 5/1956 | Fed. Rep. of Germany | 29/157 A |
| 1310017 | 10/1962 | France | 72/367 |
| 500306 | 11/1954 | Italy | 72/398 |
| 973133 | 10/1964 | United Kingdom | 72/369 |

*Primary Examiner*—E. M. Combs

*Attorney, Agent, or Firm*—Robert L. Olson

[57] ABSTRACT

An apparatus for reducing the radius of the bend in a U-shaped tube comprises two squeeze dies and a back die. The back die is hollowed to form a chamber that accommodates the bent section of the tube and supports the entire circumference of the tube at the center of the bent section. Mating slide surfaces on the back die and the squeeze dies cooperate to extend the back die during squeezing in such a manner as to accommodate the longitudinal extension of the tube legs that results from the squeezing; i.e., there is no relative longitudinal movement between the squeeze dies and the tube legs. This arrangement enables relatively thin-walled tubes to be squeezed without undue deformation of the tube.

1 Claim, 3 Drawing Figures

NO-SIZE SQUEEZING OF 180 DEGREE BOILER-TUBE RETURN BENDS

BACKGROUND OF THE INVENTION

The present invention relates to the operation, sometimes encountered in tube manufacturing, in which the radius of curvature of the bend in a U-shaped tube is reduced by squeezing, or forcing the legs toward each other but keeping them parallel. When relatively thin-walled tubes are bent, a problem is often encountered in that the bent section has a tendency to buckle or at least to have its cross section deformed to an unacceptable shape. This deformation necessitates a reshaping of the cross section of the tube after the squeezing has been completed.

Efforts to overcome this deformation are exemplified by Huet, U.S. Pat. No. 2,689,596. The Huet patent discloses complementary squeeze dies and a crotch piece. Both the squeeze dies and the crotch piece have engaging surfaces in the form of grooves whose curvature accommodates the outer diameter of the tube. In addition, the grooves are bent longitudinally to follow the desired bend in the tube. The crotch piece fits in the crotch of the U-shaped tube, while the squeeze dies fit outside and to the back of the tube. Considering the tube to be in a horizontal plane and the squeeze dies and crotch piece to be in the same plane, the Huet apparatus further includes top and bottom plates that confine the tube in a vertical direction. With this apparatus it is possible to squeeze a tube whose wall thickness is only 10% of the tube diameter. Below 10%, however, the results are unsatisfactory.

SUMMARY OF THE INVENTION

The present invention is accordingly a squeezing apparatus that can satisfactorily squeeze tubes whose wall thicknesses are less than 10% of tube diameter.

The present invention is used to squeeze a U-shaped tube that has two legs joined by a bent section. The apparatus includes a back die hollowed to form a chamber that is shaped to accommodate at least the center of the bent section of the tube and to support the entire circumference of the tube at the center of the bent section. The apparatus further includes means for squeezing the tube while the bent section is in the back die by forcing the legs of the tube toward each other but keeping them parallel. This effects the desired bend-radius reduction, and in the process the tube is extended with resect to the legs in the direction of the bent section. Preferably, the apparatus would also include means for extending the back die with respect to the legs of the tube so that the back die would be extended during squeezing. The extension means would extend the back die in such a manner as to accommodate the extension of the tube that results from the squeezing.

According to a preferred embodiment, the squeezing apparatus comprises a pair of squeeze dies, each of which has a tube-engaging surface. The dies are oriented so as to position the tube-engaging surfaces in a generally parallel relationship. The tube-engaging surfaces face each other so that a U-shaped tube may be squeezed by moving the squeeze dies together when the legs of the U-shaped tube are engaged by the dies. A further feature of the preferred embodiment is that the means for extending the back die comprises squeeze-die slide surfaces and back-die slide surfaces on the squeeze dies and back dies, respectively. The back-die slide surfaces are shaped to mate with and positioned to slideably engage the squeeze-die slide surfaces, and the slide surfaces are so angled as to force the back die in the direction in which the back section is extended when the squeeze dies are moved together.

BRIEF DESCRIPTION OF THE DRAWINGS

These and further features and advantages of the invention are described in connection with the attached drawings, in which.

DESCRIPTION OF THE PREFERRED EMBODIMENT

Figure 1:
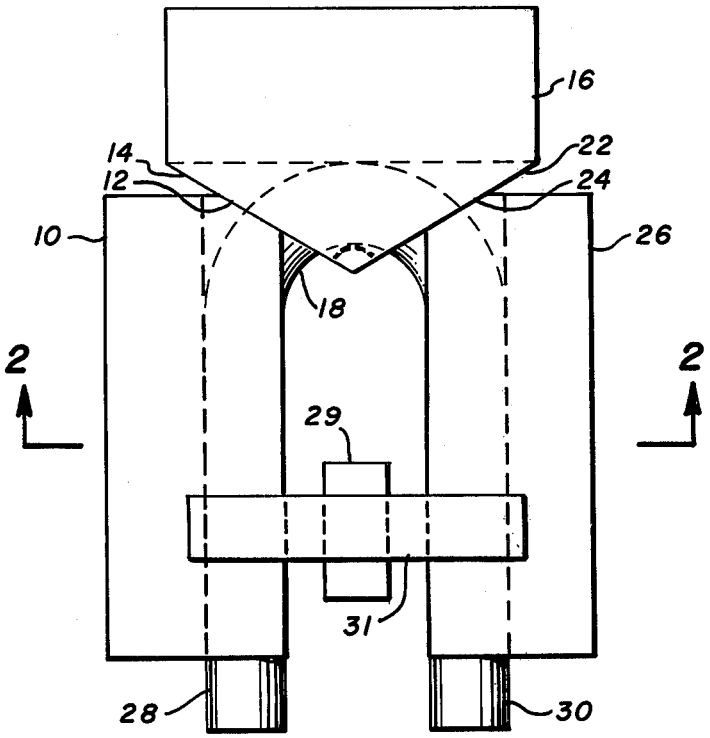
FIG. 1 is a plan view of the apparatus of the present invention.

FIG. 1 shows two squeeze dies 10 and 26 that include slide surfaces 12 and 24, respectively. The slide surfaces are machined perpendicular to the horizontal sides of the dies 10 and 26 and bear a diagonal relationship to the vertical sides of the dies 10 and 26. A back die 16 is also shown, and it too includes slide surfaces 14 and 22. These back-die slide surfaces 14 and 22 are shaped to mate with the squeeze-die slide surfaces 12 and 24.

A U-shaped tube is shown in FIG. 1. Its legs 28 and 30 fit in the squeeze dies 10 and 26, respectively, and its bent section 18 fits in the back die 16. As can be appreciated from the relationship of slide surfaces 12, 14, 22, and 24, the squeezing motion of the squeeze dies forces the back die 16 to move in the direction in which the bent section 18 is extended when the tube is squeezed. The slide surfaces are so angled that the back die moves during squeezing to accommodate the extension of the tube that results from the squeezing. Put another way, there is no relative longitudinal movement between the squeeze dies and the tube legs during the squeezing operation.

Figure 2:
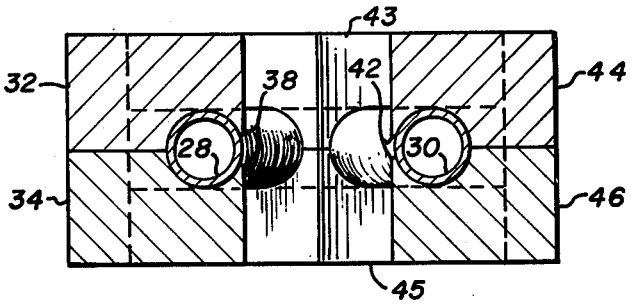
FIG. 2 is a vertical section of the apparatus taken at line 2—2 of FIG. 1.
Figure 3:
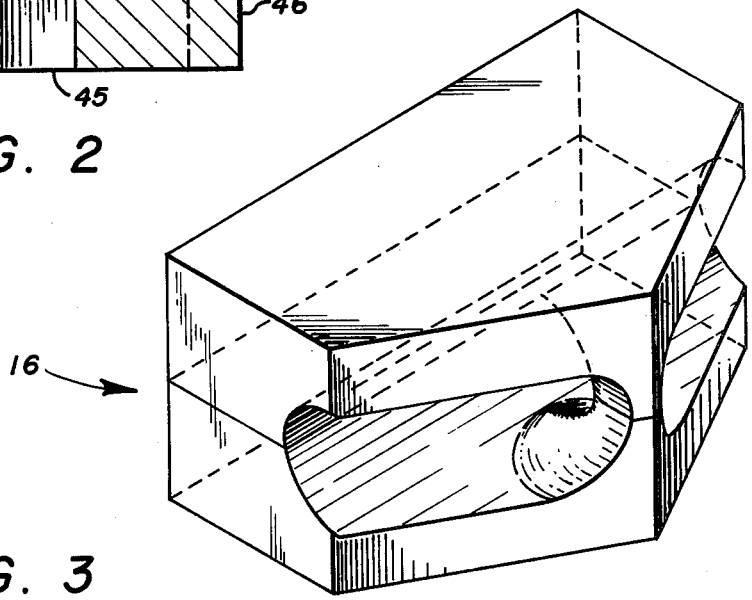
FIG. 3 is a perspective view of the back die shown in FIG. 1.

FIG. 2 shows that each of the dies is made in two sections that can be separated. The left squeeze die 10 is in two sections 32 and 34, the back die 16 is in two sections 43 and 45, and the right squeeze die 26 is made of two sections 44 and 46. A tube-engaging surface 38 on the left squeeze die 10 is shaped to engage the left leg 28 of the tube, while a similar surface 42 on the right squeeze die 26 is shaped to engage the right leg 30 of the tube. Tube-engaging surfaces 38 are positioned parallel to and generally facing the corresponding surfaces 42. As shown in FIG. 2 but best seen in FIG. 3, the back die 16 is hollowed to form a chamber that is shaped to accommodate part of the bent section of the tube and to support the entire circumference of the tube at the center of the bent section. By this arrangement, the center of the bent section of the tube is completely supported during the entire squeezing operation, while the remainder of the bent section 18 is allowed to move in the horizontal plane as is required for the radius reduction.

When it is desired to reduce the radius of a U-shaped tube, the tube is placed in the lower halves 34, 45, and 46 of the dies. The upper halves 32, 43, and 44 are then fastened in place, and a spacer block 29 (FIG. 1) is placed between the squeeze dies 10 and 26. The spacer block is attached to a support plate 31 that straddles the squeeze dies 10 and 26. It is noted that, as can be seen in FIG. 2, a squeeze die for use in the present invention can be constructed in such a form that the spacer block 29 is prevented from pressing on the legs 28 and 30 during the squeezing operation.

Once the upper halves of the dies have been fastened into place, force is applied to the squeeze dies 10 and 26 to force them together. The angle of the slide surfaces 12, 14, 22 and 24 having been picked for this purpose, the chamber formed in the back die 16 is extended at just the rate required to accommodate the desired extension of the tube during squeezing. Application of force to the squeeze dies 10 and 26 continues until the squeeze dies meet the spacer block 29, at which time the desired radius reduction has been accomplished. Since the squeeze dies 10 and 26 and the back die 16 enclose the tube during the entire operation, very little opportunity for buckling or deformation is afforded, so no sizing is required after the squeezing. This is true even when tubes are squeezed that have wall thicknesses as low a the lowest that can be bent in the preceding bending operation, around 7% of tube diameter. It is thought that even thinner-walled tubes could also be squeezed in this manner.

Though the invention has been described in connection with a specific embodiment, many alterations, modifications, and variations will be apparent to those skilled in the art in light of the foregoing description. Accordingly, it is intended to include all such alterations, modifications and variations as fall within the spirit and broad scope of the appended claims.

I claim:

1. An apparatus for reducing the bend radius of a U-shaped tube having parallel, longitudinal legs joined by a bent section, comprising: a back die hollowed to form a chamber that is shaped to accommodate a least a center of the bent section of the tube and to support the entire circumference of the tube at the center of the bent section, means for squeezing the tube by forcing the legs toward each other but keeping them generally parallel, thereby reducing the bend radius of the bent section and extending the legs longitudinally, the squeezing means including a pair of squeeze dies, each having a tube-engaging surface, the dies being oriented so that the tube-engaging surfaces are generally parallel and face each other, for squeezing a U-shaped tube by engaging the legs and moving them together, each squeeze die including a squeeze-die slide surface, the back die including back-die slide surfaces that are shaped to mate with and positioned to slidably engage the squeeze-die slide surfaces, the slide surfaces being angled such that there is no relative longitudinal movement between the squeeze dies and the legs of the tube when the squeeze dies are forced together.

* * * * *